US009647366B1

(12) United States Patent
Turowski

(10) Patent No.: US 9,647,366 B1
(45) Date of Patent: May 9, 2017

(54) CONNECTOR SHIELDING IN AN ELECTRONIC DEVICE

(71) Applicant: Microsoft Technology Licensing, LLC, Redmond, WA (US)

(72) Inventor: Daniel Joseph Turowski, Seattle, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 15/096,777

(22) Filed: Apr. 12, 2016

(51) Int. Cl.

| | |
|---|---|
| ***H01R 13/648*** | (2006.01) |
| ***H01R 12/77*** | (2011.01) |
| ***H01R 12/71*** | (2011.01) |
| ***H01R 13/6581*** | (2011.01) |
| ***H01R 13/03*** | (2006.01) |

(52) U.S. Cl.
CPC ..... *H01R 12/775* (2013.01); *H01R 12/716* (2013.01); *H01R 13/03* (2013.01); *H01R 13/6581* (2013.01)

(58) Field of Classification Search
CPC H01R 12/775; H01R 12/716; H01R 13/6581; H01R 13/03
USPC ..... 439/607.01
See application file for complete search history.

(56) References Cited

U.S. PATENT DOCUMENTS

| | | | | |
|---|---|---|---|---|
| 8,941,013 | B2 | 1/2015 | Arnold | |
| 8,992,237 | B2 | 3/2015 | Regnier et al. | |
| 2015/0311612 | A1* | 10/2015 | Qiao | H01R 12/716 439/607.01 |

FOREIGN PATENT DOCUMENTS

| | | | |
|---|---|---|---|
| EP | 0180284 | A2 | 5/1986 |

OTHER PUBLICATIONS

"Spring Finger Contacts", Retrieved on: Dec. 28, 2015 Available at: http://www.te.corniusa-en/products/connectors/pcb-connectors/board-to-board-connectors/grounding-connectors/spring-finger-contacts.html?tab=pgp-story.
"Spring Contacts", Published on: Nov. 3, 2013 Available at: http://fasprotech.com/spring-contacts.
"EZ-Spring Contacts", Retrieved on: Dec. 28, 2015 Available at: https://www.harwin.com/connector-products/featured/spring-contacts/.
Armstrong, Eur Ing Keith, "Design Techniques for EMC—Part 4 Shielding", Published on: Aug. 27, 2007 Available at: http://www.compliance-club.com/archive/old_archive/990810.htm.
(Continued)

*Primary Examiner* — Javaid Nasri
(74) *Attorney, Agent, or Firm* — Lempia Summerfield Katz LLC

(57) ABSTRACT

Connector shielding devices are described herein. One connector shielding device includes a circuit board having a connector that is connectable with a connector of an additional circuit board. The shielding device further includes a plurality of spring fingers connected to and extending from a first surface of the circuit board or a base support adjacent to the first surface of the circuit board. The plurality of spring fingers provides a perimeter around the connector of the circuit board. Additionally, each spring finger of the plurality of spring fingers is configured to deflect toward the first surface of the circuit board when the connector of the circuit board connects with the connector of the additional circuit board. Further, a Faraday cage is provided by the circuit board, the additional circuit board, and the plurality of spring fingers when the connector and the additional connector are connected.

20 Claims, 7 Drawing Sheets

(56) References Cited

OTHER PUBLICATIONS

"Essential Connector Terms and Definitions for Specifiers of Interconnect Wiring Systems", Published on: Sep. 28, 2013 Available at: http://www.glenaircom/interconnects/pdf/intro2.pdf.
Fenical, Gary, "The Basic Principles of Shielding", Published on: Mar. 1, 2014 Available at: http://incompliancemag.com/article/the-basic-principles-of-shielding/.

* cited by examiner

CONNECTOR SHIELDING IN AN ELECTRONIC DEVICE

BACKGROUND

Current design trends for electronic devices such as tablet computers or mobile phones include designs having an increase in power, a decrease in size (e.g., thickness), and an increase in speed. As the size (e.g., length, width, and/or height) of the electronic device is reduced, certain internal device components are positioned closer together. This provides for challenges in manufacturing design.

Specifically, there are challenges in manufacturing design for board-to-board connectors. Current board-to-board connectors within the electronic device may include a shielding can configured to form a Faraday cage to isolate electrical noise created by the board-to-board connection from other components within the electronic device.

SUMMARY

Connector shielding devices are described herein. In one embodiment, a device includes a circuit board having a connector that is connectable with a connector of an additional circuit board. The device further includes a plurality of spring fingers connected to and extending from a first surface of the circuit board or a base support adjacent to the first surface of the circuit board, the plurality of spring fingers providing a perimeter around the connector of the circuit board, wherein each spring finger of the plurality of spring fingers is configured to compress, deflect, or otherwise bend toward the first surface of the circuit board when the connector of the circuit board connects with the connector of the additional circuit board.

In another embodiment, a device includes a base support or cage having four surfaces, the first and second surfaces positioned in separate and parallel planes, and the third and fourth surfaces positioned in separate and parallel planes perpendicular to the planes of the first and second surfaces, wherein the third surface connects a first edge of the first surface with a first edge of the second surface and the fourth surface connects a second edge of the first surface with a second edge of the second surface. The device further includes a plurality of spring fingers extending from the first surface of the base support, wherein the base support comprises an opening between the four surfaces, wherein the opening is configured to receive a circuit board having a connector, wherein the base support is configured to abut at least a portion of four separate surfaces of the circuit board, and wherein the plurality of spring fingers is configured to provide a perimeter around the connector of the circuit board.

In another embodiment, a device includes a first circuit board having a first connector. The device further includes a second circuit board having a second connector connectable with the first connector of the first circuit board. The device further includes a plurality of spring fingers positioned between the first circuit board and the second circuit board, wherein the plurality of spring fingers provide a perimeter around the first connector and the second connector when the first connector and the second connector are connected, wherein the first circuit board, the second circuit board, and the plurality of spring fingers provide a Faraday cage when the first connector and the second connector are connected.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DESCRIPTION OF THE DRAWING FIGURES

For a more complete understanding of the disclosure, reference is made to the following detailed description and accompanying drawing figures, in which like reference numerals may be used to identify like elements in the figures.

Figure 1:
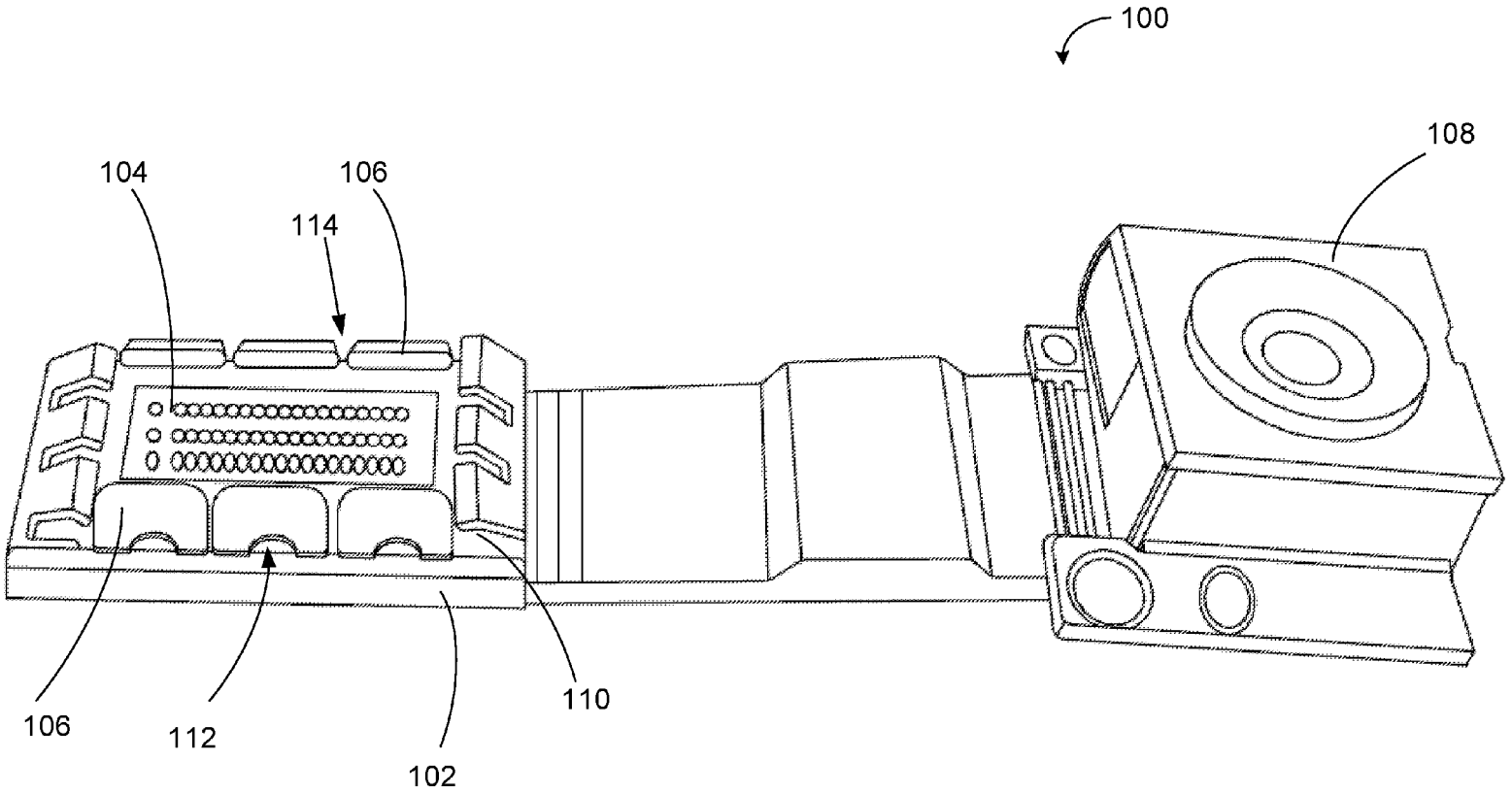
FIG. 1 depicts an example of a flexible printed circuit and a plurality of spring fingers surrounding board connectors of the flexible printed circuit.

While the disclosed devices, systems, and methods are representative of embodiments in various forms, specific embodiments are illustrated in the drawings (and are hereafter described), with the understanding that the disclosure is intended to be illustrative, and is not intended to limit the claim scope to the specific embodiments described and illustrated herein.

DETAILED DESCRIPTION

Disclosed herein are devices and systems for board-to-board connector shielding with a reduced footprint. The board-to-board connection may include a connector of a first circuit board connected to a connector of a second circuit board. A plurality of spring fingers may be positioned between the first circuit board and the second circuit board such that the plurality of spring fingers provides a perimeter around the connection between the first connector and the second connector. As such, the first circuit board, the second circuit board, and the plurality of spring fingers provide a Faraday cage for the connection.

The Faraday cage is configured to block electric fields or electric noise created by the board-to-board connection from disturbing other components (e.g. a Wi-Fi antenna within the electronic device). In the devices and systems described herein, the spring fingers are advantageous as they create part of the overall Faraday cage (in combination with the circuit boards themselves) while providing a reduced footprint for the board-to-board connection, as compared with a conventional Faraday cage device such as a shielding can. For example, a shielding can is configured to be placed over a board-to-board connection to create the Faraday cage, thereby adding height, width, and length to the board-to-board connection.

In contrast, as disclosed herein, the plurality of spring fingers may be positioned between the two circuit boards such that minimal or no height, width, or length is added to the board-to-board connection. In other words, the plurality of spring fingers may be configured to avoid adding unnecessary height or thickness to the electronic device without compromising on shielding.

Such a connector shielding device may be useful in any electronic device having a board-to-board connector arrangement (e.g., mobile phone having a camera, wherein the camera is part of a flexible printed circuit connected to a printed circuit board). In some examples, the board-to-board connector shielding may be incorporated into a personal computer, server computer, tablet or other handheld computing device, laptop or mobile computer, communication device such as a mobile phone, multiprocessor system, microprocessor-based system, set top box, programmable consumer electronic, network PC, minicomputer, mainframe computer, or audio or video media player. In certain examples, the connector shielding may be incorporated within a wearable electronic device, wherein the device may be worn on or attached to a person's body or clothing. The wearable device may be attached to a person's shirt or jacket; worn on a person's wrist, ankle, waist, or head; or worn over their eyes or ears. Such wearable devices may include a watch, heart-rate monitor, activity tracker, or head-mounted display.

Examples of Connector Shielding Devices

FIG. 1 depicts an example of an electronic device 100 that includes a circuit board 102 having a connector 104 and a plurality of spring fingers 106. Any type of board in an electronic device having a connector that requires shielding may be provided. In this example, the circuit board 102 is a flexible printed circuit (FPC). In other examples, the circuit board may be a rigid, printed circuit board (PCB). The material of the circuit board is configurable to provide the rigidity or flexibility needed in the circuit board. In some examples, the circuit board is made out of a plastic, polymer (e.g., polyester, polyimide, polyethylene napthalate, polyetherimide, fluropolymers, copolymers), laminate, copper-clad laminate, resin impregnated B-stage cloth, or copper foil.

The circuit board 102 within the electronic device 100 may be used for any application or function that requires one board to be connected to another board, such as in a mobile electronic device (e.g., mobile phone, tablet computer). For example, as depicted in FIG. 1, the flexible printed circuit 102 is configured to connect a camera module 108 (e.g., having at least one lens, filter, and/or sensor) to an additional circuit board. In another example, one circuit board is used to connect a computer peripheral (e.g., keyboard) to a second circuit board (e.g., the motherboard).

The type of connector arrangement between circuit boards is also configurable. In one example, a plug-socket connector arrangement is provided. In another example, the connectors may be spring contacts on exposed pads.

The plurality of spring fingers 106 is configured to provide a perimeter around the connector 104 of the circuit board 102. When the connector 104 of the circuit board 102 is connected with a connector of an additional circuit board, each spring finger of the plurality of spring fingers 106 is configured to compress, deflect, or bend toward a first surface 110 of the circuit board 102. This is advantageous as the plurality of spring fingers 106 may provide shielding for the connector 104 and additional connector when the two are connected.

The plurality of spring fingers 106 may be formed from any composition and in any shape that effectively shields electrical noise generated by the connection from any surrounding systems or components in the electronic device. Additionally, the composition and/or shape may be configurable to provide a desired flexibility for compressing, deflecting, or bending the spring fingers 106 when the connector 104 of the circuit board 102 is connected with the additional connector of the additional circuit board. Further, the composition and/or shape of the spring fingers 106 may be configurable to provide a desired spring force (e.g., a spring force that is less than the retention force of the board-to-board connection). For example, the spring fingers may be made out of one or more metals or metal alloys. The metals or metal alloys may be electrically and/or thermally conductive. In some examples, the composition of the spring fingers is selected from the group consisting of silver, copper, gold, aluminum, zinc, nickel, brass, bronze, iron, platinum, tin, tungsten, lithium, molybdenum, carbon, steel, lead, alloys thereof, and combinations thereof.

In some examples, one or more of the spring fingers 106 include an aperture or opening 112 in the spring finger. The aperture 112 may be advantageous in reducing the weight of the connector shielding (e.g., the plurality of spring fingers) and therefore reduce the overall weight of the electronic device 100. Additionally, the apertures 112 may be advantageous in providing a desired flexibility of the spring fingers 106 and therein a desired spring force when the board-to-board connection is made. The apertures 112 may be of any particular shape, such as a circle, square, rectangle. The apertures 112 may be configured such that spring fingers 106 still effectively shield electrical noise generated by the connection from other electrical components in the device, such as an antenna operating at a W-Fi frequency (e.g., 2.4 GHz or 5 GHz). That is, the apertures 112 are not so large that noise from the connection affects surrounding components in the electronic device 100. In some examples, the height and width of the apertures 112 are each less than 3 mm, 2.5 mm, 2 mm, 1.5 mm, 1 mm, 0.5 mm, or 0.1 mm. In alternative examples, the diameter of the aperture is less than 3 mm, 2.5 mm, 2 mm, 1.5 mm, 1 mm, 0.5 mm, or 0.1 mm.

In addition to, or in the alternative from the apertures 112 in the spring fingers 106, the plurality of spring fingers 106 may include gaps or openings 114 between adjacent spring fingers. Like apertures 112 within the spring finger 106, the gaps or openings 114 between adjacent spring fingers may be advantageous in reducing the overall weight of the connector shielding and therein the overall weight of the electronic device 100. Additionally, the gaps 114 may be advantageous in providing a desired flexibility of the plurality of spring fingers 106 and therein a desired spring force when the board-to-board connection is made. Like the apertures 112 in the spring fingers 106, the openings 114 between adjacent spring fingers may be configured to be small enough to effectively shield the electrical noise from surrounding components in the device. In some examples, the gaps 114 or distances between each pair of adjacent fingers (e.g., between the adjacent edges of the adjacent spring fingers, as measured in a parallel direction with the surface of the circuit board), are each less than 3 mm, 2.5 mm, 2 mm, 1.5 mm, 1 mm, 0.5 mm, or 0.1 mm.

In certain examples, the plurality of spring fingers 106 is connected to a first surface 110 of the circuit board 102 at an end of each spring finger. From the connection to the first surface 110, each finger extends outward toward an additional circuit board connectable with the circuit board 102. Any method or material for attaching the spring fingers 106 to the circuit board is possible. For example, the spring fingers 106 may be attached to the surface 110 of the circuit board 102 by soldering (e.g., surface mount soldering). Alternatively, the spring fingers 106 may be adhered to the circuit board 102 via an adhesive composition or layer. In other examples, the spring fingers 106 may be mechanically attached, press fit, or interlocked to the circuit board 102.

In other examples, the plurality of spring fingers 106 is connected to and extends from a base support or cage that is adjacent to the first surface of the circuit board.

The plurality of spring fingers 106 may be individual spring fingers that are each connected to the circuit board or the base support (e.g., cage) adjacent to the circuit board. Alternatively, the plurality of spring fingers 106 may include groups or arrays of interconnected spring fingers. Each group or array may be connected to the circuit board or the base support (e.g., cage) adjacent to the circuit board. In yet other examples, the plurality of spring fingers 106 may be a single piece of material (e.g., metal) that is connected to the circuit board or the base support (e.g., cage) adjacent to the circuit board.

Figure 2:
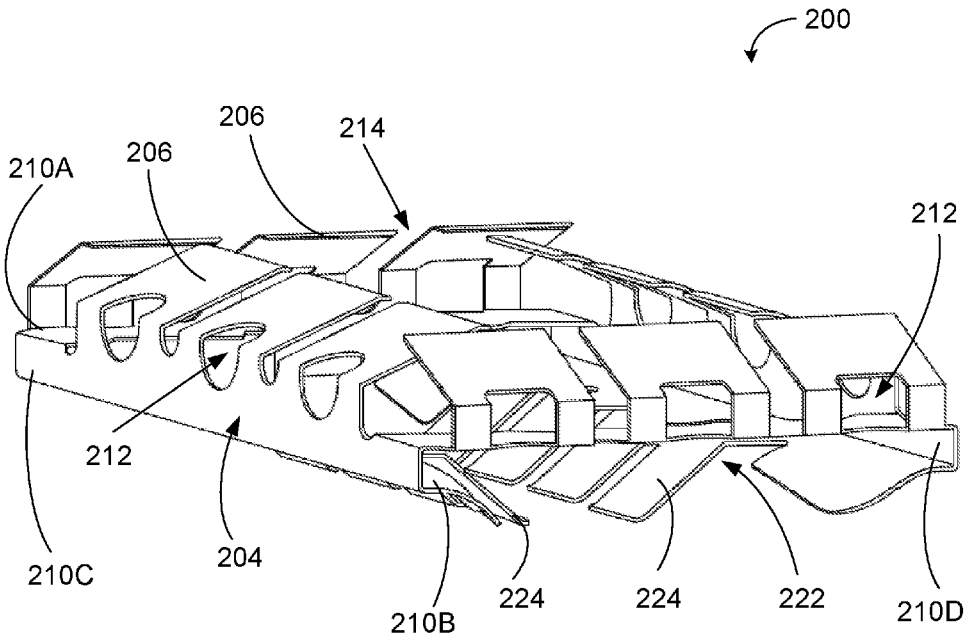
FIG. 2 depicts an example of a device having a plurality of spring fingers.

FIG. 2 depicts an example of a device 200 including a base support or cage 204 configured to at least partially cover one or more surfaces of a circuit board. In certain examples, one or more internal surfaces of the base support 204 abut one or more surfaces of the circuit board. This is advantageous, as any gap between the base support and the circuit board surface may add unnecessary height, length, or width to the board-to-board connection.

The device 200 also includes a plurality of spring fingers 206. In certain examples, the base support 204 and one or more of the spring fingers 206 may be separate structures that are connected or attached to each other. Any method or material for attaching the spring fingers 206 to a surface of the base support 204 is possible. For example, the spring fingers 206 may be connected or attached to the base support 204 by soldering (e.g., surface mount soldering). Alternatively, the spring fingers 206 may be adhered to the base support 204 via an adhesive composition or layer. In other examples, the spring fingers 206 may be mechanically attached, press fit, or interlocked to the base support 204.

Alternatively, the base support 204 and the spring fingers 206 may be a single piece of material. This may be advantageous as the single piece of material eliminates the need to connect the spring fingers 206 to the base support 204 via an additional material or layer, such as solder or adhesive (which may cause an increase in the height, width, or length of the device).

The composition of the base support 204 and the spring fingers 206 may be any composition that effectively shields electrical noise generated by the connection from any surrounding systems or components in the electronic device. For example, the base support 204 and spring fingers 206 may be made out of one or more metals or metal alloys. The metals or metal alloys may be electrically and/or thermally conductive. In some examples, the composition of the base support 204 and the spring fingers 206 is selected from the group consisting of silver, copper, gold, aluminum, zinc, nickel, brass, bronze, iron, platinum, tin, tungsten, lithium, molybdenum, carbon, steel, lead, alloys thereof, and combinations thereof.

A spring finger 206 may include an aperture 212 within the spring finger, or a gap 214 between adjacent spring fingers. As noted above, the apertures 212 and/or gaps 214 are configured to be small enough for the plurality of spring fingers 206 to function as a Faraday cage and effectively shield electrical noise generated by the board-to-board connection from other electrical components in the device, such as an antenna operating at a W-Fi frequency (e.g., 2.4 GHz or 5 GHz).

The base support or cage 204 may configured to cover or envelope at least a portion of multiple surfaces of the circuit board. For example, the base support 204 may be bent or folded over portions of several surfaces of the circuit board from a sheet of material (e.g., metal). Alternatively, the base support 204 may be constructed into a three-dimensional structure having an internal volume for placement of the circuit board. The base support 204 may be configured to have an opening 222 in one side of the three-dimensional structure. The size of the opening 222 may be configured to allow the circuit board to be slid or inserted into the opening 222 and positioned within the internal volume of the base support 204.

The base support 204 depicted in FIG. 2 includes several surfaces configured to at least partially cover a circuit board. As depicted, the base support 204 includes four walls or surfaces 210A, 210B, 210C, 210D configured to cover or abut at least a portion of four separate surfaces of the circuit board. The first and second surfaces 210A, 210B of the base support 204 are positioned in separate and parallel planes. The third and fourth surfaces 210C, 210D are also positioned in separate and parallel planes, wherein the third and fourth surfaces 210C, 210D are in planes perpendicular to the planes of the first and second surfaces 210A, 210B. Additionally, the third surface 210C connects a first edge of the first surface 210A with a first edge of the second surface 210B. Similarly, the fourth surface 210D connects a second edge of the first surface 210A with a second edge of the second surface 210B.

Additionally, as depicted in FIG. 2, the opening 222 at one end of the three-dimensional structure is created by the four walls or surfaces 210A, 210B, 210C, 210D. The opening 222 is configured to receive a circuit board having a connector.

Additionally, the device 200 includes a plurality of spring fingers 206 provided on and extending from the first surface 210A or first plane of the base support 204. When the circuit board and connector are inserted into the opening of the base support 204 (positioned in a second plane, perpendicular with the first plane), the plurality of spring fingers 206 are configured to provide a perimeter around the connector of the circuit board.

In certain examples, at least one additional spring finger 224 may be positioned on and extend from a second surface 210B of the base support 204. The at least one additional spring finger 224 may be connected to the base support 204 via soldering, adhering, or any other connection method. Alternatively, the at least one additional spring finger 224 may be part of a single piece of material (e.g., metal) as the base support 204 and, in some instances, the plurality of spring fingers 206.

As depicted in FIG. 2, the at least one additional spring finger 224 is positioned on the second surface 210B of the base support 204, the second surface being parallel with the first surface 210A. The at least one additional spring finger 224 extends in a direction opposite from the direction of the plurality of spring fingers 206. The additional spring finger 224 may be advantageous in providing an opposing spring force that assists in keeping the connection between the connector on the circuit board and additional connector on the additional circuit board from detaching.

For example, the connection between the two circuit board connectors provides a coupling or retention force (e.g., the force needed to uncouple the two circuit boards).

Additionally, when the two circuit board connectors are connected, the plurality of spring fingers 206 are compressed, deflected, or bent downward toward the base support 204 or circuit board from which they extend. This compression, deflection, or bending of the spring fingers 206 creates a spring force for the spring fingers in an opposite direction of the retention force.

In some examples, the retention force of the board-to-board connection is greater than the spring force for the spring fingers (in aggregate), and no additional components are needed to retain the two circuit boards together. In certain alternative examples, the retention force is equal to or less than the spring force, such that it is difficult to keep the two circuit board connectors connected with each other. In this situation, the at least one additional spring finger 224 is provided on the second surface 210B of the base support 204 (or the circuit board, in some examples). The at least one additional spring finger 224 may be configured to abut a component of the electronic device (e.g., a battery, vapor chamber, heat pipe, heat sink, heat fin, chassis/enclosure or shell, display). For example, when the at least one additional spring finger 224 is placed against the component of the electronic device, the additional spring finger 224 bends, deflects, or compresses toward the second surface 210B of the base support 204 (or circuit board), therein providing an opposing spring force (or additional retention force).

The retention force of the connections combined with the opposing spring force of the additional spring finger are configured to be greater than the collective spring force of the plurality of spring fingers between the two circuit boards. This is advantageous to maintain the connection between the two connectors of the two circuit boards.

Figure 3A:
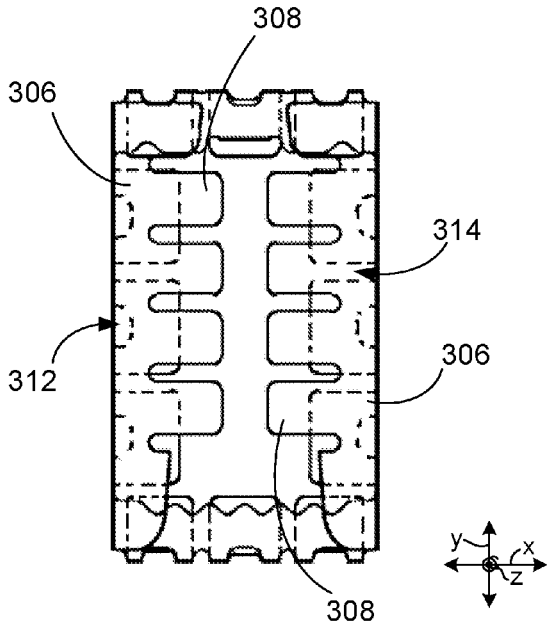
FIG. 3A depicts a top-down perspective of an example of a device having a plurality of spring fingers.
Figure 3B:
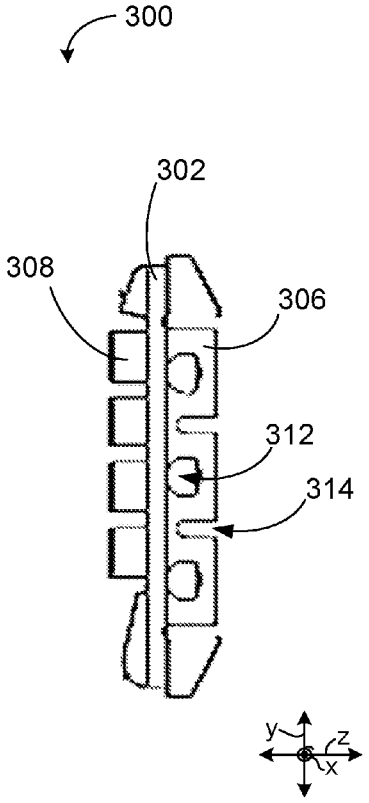
FIGS. 3B and 3C depict side-view perspectives of the device in FIG. 3A.
Figure 3C:
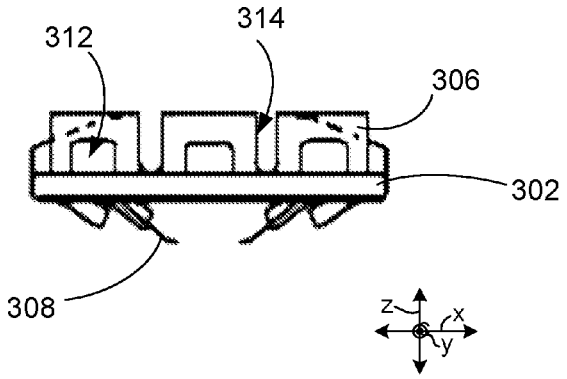

FIGS. 3A-3C depict different perspectives of a device 300 having spring fingers extending from opposite sides of a circuit board 302. FIG. 3A depicts a top-down perspective of the device having a plurality of spring fingers 306 on one side of a circuit board (depicted in dashed line), and at least one additional spring finger 308 extending from the opposite side of the circuit board. FIGS. 3B and 3C depict side-view perspectives of the device in FIG. 3A. The spring figures 306, 308 may be attached directly to the circuit board 302, or may be attached to a base support configured to abut one or more surfaces of the circuit board. As discussed above, the spring fingers 306, 308 may be soldered, adhered, mechanically attached, press fit, interlocked, or otherwise attached to the circuit board directly or the base support adjacent to the circuit board. Alternatively, the spring fingers 306, 308 may be part of a single piece of material (e.g., metal) of a base support. Like the examples in FIGS. 1 and 2, the example in FIGS. 3A-3C includes apertures 312 within certain spring fingers 306, and gaps 314 between certain spring fingers 306.

Figure 4A:
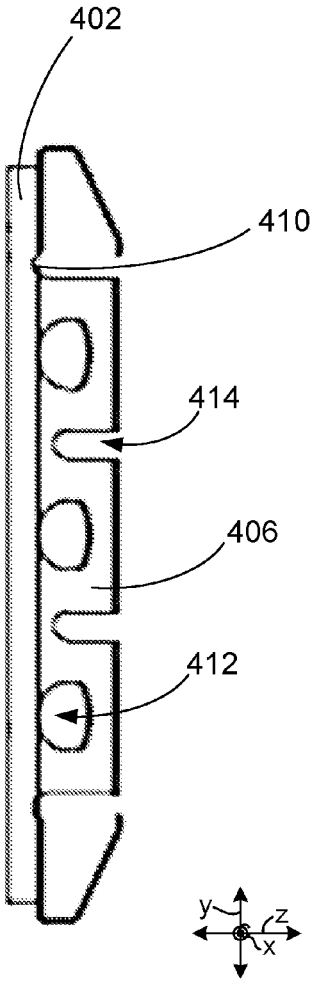
FIGS. 4A and 4B depict side-view perspectives of an example of a circuit board having a plurality of spring fingers.
Figure 4B:
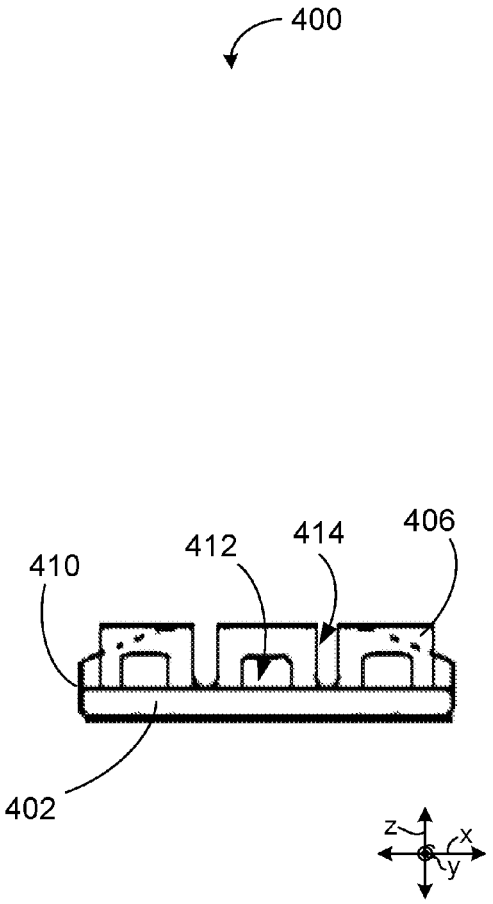

FIGS. 4A and 4B depict side-view perspectives of a device 400 having a circuit board 402 and a plurality of spring fingers 406 extending from one surface 410 of the circuit board 402. In comparison with FIGS. 3A-3C, the device 400 in FIGS. 4A and 4B does not include any additional spring finger extending from a second surface of the circuit board opposite the first surface. The spring figures 406 in FIGS. 4A and 4B may be attached directly to the circuit board 402, or may be attached to a base support configured to abut the surface 410 of the circuit board 402. The spring fingers 406 may be soldered, adhered, mechanically attached, press fit, interlocked, or otherwise attached to the circuit board directly or the base support adjacent to the circuit board. Alternatively, the spring fingers 406 may be part of a single piece of material (e.g., metal) of a base support. Again, the spring fingers 406 may include apertures 412 within certain spring fingers 406, and gaps 414 between certain spring fingers 406.

Figure 5:
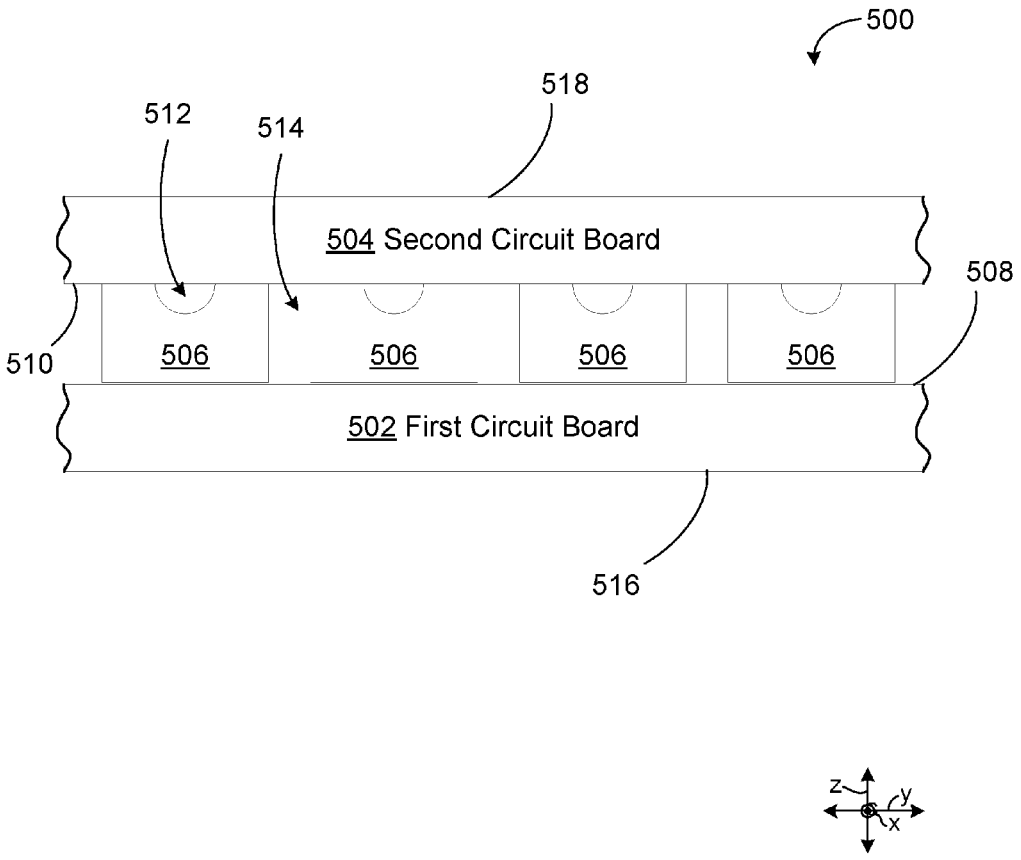
FIG. 5 depicts an example of a side-view perspective of a board-to-board connection including a plurality of spring fingers positioned between the two circuit boards.

FIG. 5 depicts a side-view perspective of a device 500 having a board-to-board connection. In this example, the first circuit board 502 includes a first connector, and the second circuit board 504 includes a second connector that is connectable with the first connector. In one example, the first circuit board 502 is a flexible printed circuit, and the second circuit board 504 is a rigid printed circuit board. In an alternative example, the first circuit board 502 is a rigid printed circuit board and the second circuit board 504 is a rigid printed circuit board.

A plurality of spring fingers 506 is positioned between the first circuit board 502 and the second circuit board 504. In one example, all of the spring fingers are connected to and extend from the first circuit board 502 or a base support abutting a surface 508 the first circuit board 502. In an alternative example, a fraction (less than all) of the plurality of spring fingers is connected to and extends from the surface 508 of the first circuit board 502 or a base support adjacent to the surface 508 of the first circuit board 502, and a remaining fraction of the plurality of spring fingers is connected to and extends from a surface 510 of the second circuit board 504 or a base support adjacent to the surface 510 of the second circuit board 504. For example, one array or wall of spring fingers may be attached to one circuit board (or base support adjacent to the circuit board), and the remaining arrays or walls of spring fingers (e.g., three arrays or walls) may be attached to the second circuit board (or base support). In another example, two arrays or walls of spring fingers are attached to each circuit board (or a base support adjacent to the circuit board).

The plurality of spring fingers 506 provides a perimeter around the first connector and the second connector when the first connector and the second connector are connected. Additionally, a Faraday cage is created when the first connector and the second connector are connected. For example, the first circuit board 502 (or a ground plate of the first circuit board) provides a first wall, the second circuit board 504 (or a ground plate of the first circuit board) provides the second wall, and the plurality of spring fingers 506 provide the remaining walls (e.g., four walls) to create the Faraday cage that encloses the first and second connectors.

As noted above, the connection between the first and second connector may generate electrical noise during operation of the electronic device. The circuit boards 502, 504 and plurality of spring fingers 506 are configured to shield the electrical noise from other electrical components in the device (e.g., an antenna).

In the example depicted in FIG. 5, one or more of the spring fingers 506 include an aperture 512 within the spring finger 506 or opening 514 between adjacent spring fingers 506. The apertures 512 or openings 514 may be of any particular shape such that the apertures/openings remain small enough still effectively shield the electrical noise from the other electrical components in the device 500.

As noted above, the connection between the two circuit board connectors provides a coupling or retention force (e.g., a force needed to uncouple the two circuit boards). Additionally, when the two circuit board connectors are connected, the plurality of spring fingers 506 are compressed, deflected, or bent downward toward the base support or circuit board from which they extend. This bending, deflection, or compression of the spring fingers 506 creates a spring force in an opposite direction of the retention force.

In the example depicted in FIG. 5, the retention force is greater than the spring force, and no additional components are needed to retain the two circuit boards together.

In certain alternative examples, the retention force may be equal to or less than the spring force. In this situation, at least one additional spring finger may be provided on a second surface 516, 518 of either (or both) circuit board 502, 504 (or a base support adjacent to the circuit board). The additional spring finger may be designed to abut a component (e.g., a battery, vapor chamber, heat pipe, heat sink, heat fin, chassis/enclosure or shell, display) within the electronic device, such that the component bends, deflects, or compresses the additional spring finger toward the surface 516, 518 of the circuit board 502, 504. The additional spring finger provides an opposing spring force (or additional retention force). The additional spring finger(s) may be designed such that the sum of the retention force from the board-to-board connection and the opposing spring force from the additional spring finger(s) is greater than the spring force created from the plurality of spring fingers 506.

Figure 6:
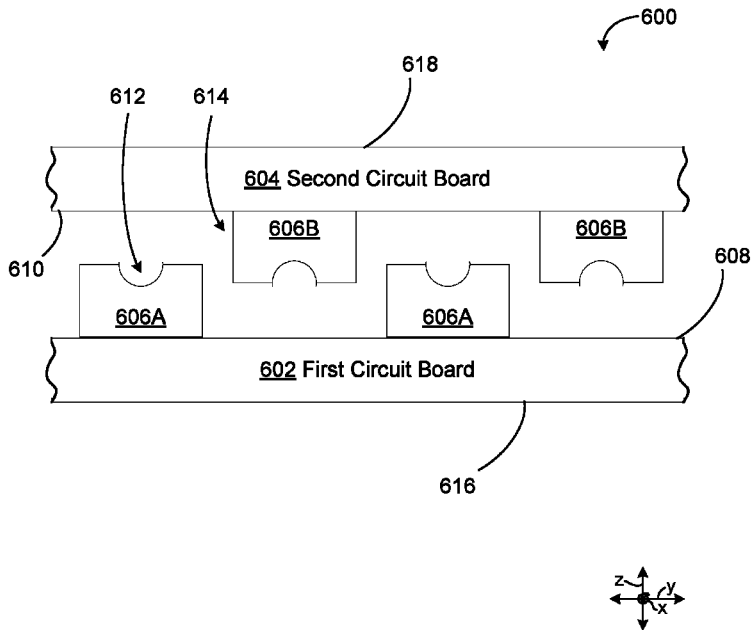
FIG. 6 depicts an additional example of a side-view perspective of a board-to-board connection including a first plurality of spring fingers and a second plurality of spring fingers positioned between the two circuit boards.

FIG. 6 depicts an additional side-view perspective of a device 600 having a board-to-board connection. In this example, the first circuit board 602 includes a first connector, and the second circuit board 604 includes a second connector that is connectable with the first connector. In one example, the first circuit board 602 is a flexible printed circuit, and the second circuit board 604 is a rigid printed circuit board. In an alternative example, the first circuit board 602 is a rigid printed circuit board and the second circuit board 604 is a rigid printed circuit board.

In this example, the plurality of spring fingers are composed of at least two groups or fractions: (1) a first plurality of spring fingers 606A, which is connected to and extends from the surface 608 of the first circuit board 602 or a base support adjacent to the surface 608 of the first circuit board 602, and (2) a second plurality of spring fingers 606B, which is connected to and extends from a surface 610 of the second circuit board 604 or a base support adjacent to the surface 610 of the second circuit board 604.

The first plurality of spring fingers 606A and the second plurality of spring fingers 606B may be configured to nest together to provide a perimeter around the first connector and the second connector when the first connector and the second connector are connected. Additionally, a Faraday cage is created when the first connector and the second connector are connected. For example, the first circuit board 602 (or a ground plate of the first circuit board) provides a first wall, the second circuit board 604 (or a ground plate of the first circuit board) provides the second wall, and the plurality of spring fingers 606A, 606B provide the remaining walls (e.g., four walls) to create the Faraday cage that encloses the first and second connectors.

As depicted in FIG. 6, the pluralities of spring fingers 606A, 606B between the two circuit boards 602, 604 may be configured in an alternating pattern, wherein one spring finger extending from one circuit board is positioned between two spring fingers extending from the other circuit board. Other arrangements are also possible.

In the example depicted in FIG. 6, one or more of the spring fingers 606A, 606B include an aperture 612 within the spring finger 606A, 606B or opening 614 between adjacent spring fingers 606A, 606B. The apertures 612 or openings 614 may be of any particular shape such that the apertures/openings remain small enough still effectively shield the electrical noise from the other electrical components in the device 600.

Exemplary Computing Environment

Figure 7:
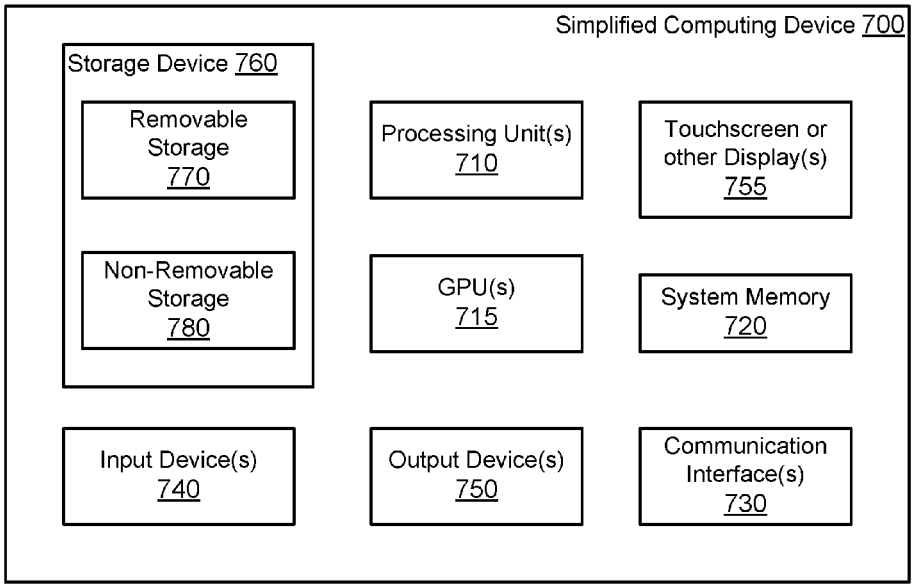
FIG. 7 is a block diagram of a computing environment in accordance with one example for implementation of the disclosed board-to-board connections.

With reference to FIG. 7, the connector shielding as described above may be incorporated within an exemplary electronic device or computing environment 700. The computing environment 700 may correspond with one of a wide variety of computing devices having a board-to-board connection, including, but not limited to, personal computers (PCs), server computers, tablet and other handheld computing devices, laptop or mobile computers, communications devices such as mobile phones, multiprocessor systems, microprocessor-based systems, set top boxes, programmable consumer electronics, network PCs, minicomputers, mainframe computers, or audio or video media players. In certain examples, the computing environment 700 is a wearable electronic device, wherein the device may be worn on or attached to a person's body or clothing.

The computing environment 700 has sufficient computational capability and system memory to enable basic computational operations. In this example, the computing environment 700 includes one or more processing unit(s) 710, which may be individually or collectively referred to herein as a processor. The computing environment 700 may also include one or more graphics processing units (GPUs) 715. The processor 710 and/or the GPU 715 may include integrated memory and/or be in communication with system memory 720. The processor 710 and/or the GPU 715 may be a specialized microprocessor, such as a digital signal processor (DSP), a very long instruction word (VLIW) processor, or other microcontroller, or may be a general purpose central processing unit (CPU) having one or more processing cores. The processor 710, the GPU 715, the system memory 720, and/or any other components of the computing environment 700 may be packaged or otherwise integrated as a system on a chip (SoC), application-specific integrated circuit (ASIC), or other integrated circuit or system.

The computing environment 700 may also include other components, such as, for example, a communications interface 730. One or more computer input devices 740 (e.g., pointing devices, keyboards, audio input devices, video input devices, haptic input devices, or devices for receiving wired or wireless data transmissions) may be provided. The input devices 740 may include one or more touch-sensitive surfaces, such as track pads. Various output devices 750, including touchscreen or touch-sensitive display(s) 755, may also be provided. The output devices 750 may include a variety of different audio output devices, video output devices, and/or devices for transmitting wired or wireless data transmissions.

The computing environment 700 may also include a variety of computer readable media for storage of information such as computer-readable or computer-executable instructions, data structures, program modules, or other data. Computer readable media may be any available media accessible via storage devices 760 and includes both volatile and nonvolatile media, whether in removable storage 770 and/or non-removable storage 780. Computer readable media may include computer storage media and communication media. Computer storage media may include volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which may be used to store the desired information and which may be accessed by the processing units of the computing environment 700.

While the present claim scope has been described with reference to specific examples, which are intended to be illustrative only and not to be limiting of the claim scope, it will be apparent to those of ordinary skill in the art that changes, additions and/or deletions may be made to the disclosed embodiments without departing from the spirit and scope of the claims.

The foregoing description is given for clearness of understanding only, and no unnecessary limitations should be understood therefrom, as modifications within the scope of the claims may be apparent to those having ordinary skill in the art.

Claim Support Section

In a first embodiment, a device comprises a circuit board having a connector that is connectable with a connector of an additional circuit board, and a plurality of spring fingers connected to and extending from a first surface of the circuit board or a base support adjacent to the first surface of the circuit board, the plurality of spring fingers providing a perimeter around the connector of the circuit board, wherein each spring finger of the plurality of spring fingers is configured to deflect toward the first surface of the circuit board when the connector of the circuit board connects with the connector of the additional circuit board.

In a second embodiment, a device comprises a base support having four surfaces, the first and second surfaces positioned in separate and parallel planes, and the third and fourth surfaces positioned in separate and parallel planes perpendicular to the planes of the first and second surfaces, wherein the third surface connects a first edge of the first surface with a first edge of the second surface and the fourth surface connects a second edge of the first surface with a second edge of the second surface, and a plurality of spring fingers extending from the first surface of the base support, wherein the base support comprises an opening between the four surfaces, wherein the opening is configured to receive a circuit board having a connector, wherein the base support is configured to abut at least a portion of four separate surfaces of the circuit board, and wherein the plurality of spring fingers is configured to provide a perimeter around the connector of the circuit board.

In a third embodiment, with reference to the first or second embodiment, the circuit board is a printed circuit board or a flexible printed circuit.

In a fourth embodiment, with reference to any of embodiments 1-3, the plurality of spring fingers comprises at least one conductive metal selected from the group consisting of silver, copper, gold, aluminum, zinc, nickel, brass, bronze, iron, platinum, tin, tungsten, lithium, molybdenum, carbon, steel, lead, alloys thereof, and combinations thereof.

In a fifth embodiment, with reference to any of embodiments 1-4, the plurality of spring fingers is connected to the first surface of the circuit board.

In a sixth embodiment, with reference to any of embodiments 1-5, the plurality of spring fingers is soldered to the first surface of the circuit board.

In a seventh embodiment, with reference to any of embodiments 1-6, each spring finger of the plurality of spring fingers is connected to the base support along a first plane of the base support, wherein the base support comprises an opening located in a second plane perpendicular to the first plane, wherein the opening is configured to receive the circuit board such that the base support abuts at least a portion of four separate surfaces of the circuit board.

In an eighth embodiment, with reference to any of embodiments 1-7, the device further comprises at least one spring finger extending from a second surface of the circuit board or the base support adjacent to the second surface of the circuit board, the second surface being opposite from and parallel with the first surface.

In a ninth embodiment, with reference to any of embodiments 1-8, the base support and the plurality of spring fingers are single piece of conductive metal.

In a tenth embodiment, a device comprises a first circuit board having a first connector, a second circuit board having a second connector connectable with the first connector of the first circuit board, and a plurality of spring fingers positioned between the first circuit board and the second circuit board, wherein the plurality of spring fingers provide a perimeter around the first connector and the second connector when the first connector and the second connector are connected, wherein the first circuit board, the second circuit board, and the plurality of spring fingers provide a Faraday cage when the first connector and the second connector are connected.

In an eleventh embodiment, with reference to the tenth embodiment, the first circuit board is a printed circuit board, and the second circuit board is a flexible printed circuit.

In a twelfth embodiment, with reference to the tenth embodiment, the first circuit board and the second circuit board are printed circuit boards.

In a thirteenth embodiment, with reference to any of embodiments 10-12, the first connector is a plug and the second connector is a socket.

In a fourteenth embodiment, with reference to any of embodiments 10-13, a retention force is provided by the connection of the first connector and the second connector, wherein a spring force is provided in an opposite direction of the retention force by a deflection of the spring fingers between the first and second circuit boards when the first connector and the second connector are connected, and wherein the retention force is greater than the spring force.

In a fifteenth embodiment, with reference to any of embodiments 10-14, the plurality of spring fingers is connected to and extends from a first surface of the first circuit board or a base support adjacent to the first surface of the first circuit board.

In a sixteenth embodiment, with reference to the fifteenth embodiment, the device further comprises at least one spring finger extending from a second surface of the first circuit board or a base support adjacent to the second surface of the first circuit board, the second surface being opposite from and parallel with the first surface.

In a seventeenth embodiment, with reference to the sixteenth embodiment, a retention force is provided by the connection of the first connector and the second connector, wherein a spring force is provided in an opposite direction of the retention force by a deflection of the spring fingers between the first and second circuit boards when the first connector and the second connector are connected, wherein an opposing spring force is provided by a deflection of the at least one spring finger extending from the second surface by a component adjacent to second surface of the first circuit board, and wherein a sum of the retention force and the opposing spring force is greater than the spring force.

In an eighteenth embodiment, with reference to any of embodiments 10-17, a fraction of the plurality of spring fingers is connected to and extends from a first surface of the first circuit board or a base support adjacent to the first surface of the first circuit board, and wherein a remaining fraction of the plurality of spring fingers is connected to and extends from a first surface of the second circuit board or a base support adjacent to the first surface of the second circuit board.

What is claimed is:

1. A device comprising:

a circuit board having a connector that is connectable with a connector of an additional circuit board; and a plurality of spring fingers connected to and extending from a first surface of the circuit board or a base support adjacent to the first surface of the circuit board, the plurality of spring fingers providing a perimeter around the connector of the circuit board, wherein each spring finger of the plurality of spring fingers is configured to deflect toward the first surface of the circuit board when the connector of the circuit board connects with the connector of the additional circuit board.

2. The device of claim 1, wherein the circuit board is a printed circuit board or a flexible printed circuit.

3. The device of claim 1, wherein the plurality of spring fingers comprises at least one conductive metal selected from the group consisting of silver, copper, gold, aluminum, zinc, nickel, brass, bronze, iron, platinum, tin, tungsten, lithium, molybdenum, carbon, steel, lead, alloys thereof, and combinations thereof.

4. The device of claim 1, wherein the plurality of spring fingers is connected to the first surface of the circuit board.

5. The device of claim 4, wherein the plurality of spring fingers is soldered to the first surface of the circuit board.

6. The device of claim 1, wherein each spring finger of the plurality of spring fingers is connected to the base support along a first plane of the base support, wherein the base support comprises an opening located in a second plane perpendicular to the first plane, wherein the opening is configured to receive the circuit board such that the base support abuts at least a portion of four separate surfaces of the circuit board.

7. The device of claim 1, further comprising at least one spring finger extending from a second surface of the circuit board or the base support adjacent to the second surface of the circuit board, the second surface being opposite from and parallel with the first surface.

8. A device comprising:

a base support having four surfaces, the first and second surfaces positioned in separate and parallel planes, and the third and fourth surfaces positioned in separate and parallel planes perpendicular to the planes of the first and second surfaces, wherein the third surface connects a first edge of the first surface with a first edge of the second surface and the fourth surface connects a second edge of the first surface with a second edge of the second surface; and a plurality of spring fingers extending from the first surface of the base support, wherein the base support comprises an opening between the four surfaces, wherein the opening is configured to receive a circuit board having a connector, wherein the base support is configured to abut at least a portion of four separate surfaces of the circuit board, and wherein the plurality of spring fingers is configured to provide a perimeter around the connector of the circuit board.

9. The device of claim 8, wherein the base support and the plurality of spring fingers are single piece of conductive metal.

10. The device of claim 9, wherein the conductive metal comprises silver, copper, gold, aluminum, zinc, nickel, brass, bronze, iron, platinum, tin, tungsten, lithium, molybdenum, carbon, steel, lead, alloys thereof, or combinations thereof.

11. The device of claim 8, further comprising:

at least one spring finger extending from the second surface of the base support.

12. A device comprising:

a first circuit board having a first connector;

a second circuit board having a second connector connectable with the first connector of the first circuit board; and a plurality of spring fingers positioned between the first circuit board and the second circuit board, wherein the plurality of spring fingers provide a perimeter around the first connector and the second connector when the first connector and the second connector are connected, wherein the first circuit board, the second circuit board, and the plurality of spring fingers provide a Faraday cage when the first connector and the second connector are connected.

13. The device of claim 12, wherein the first circuit board is a printed circuit board, and the second circuit board is a flexible printed circuit.

14. The device of claim 12, wherein the first circuit board and the second circuit board are printed circuit boards.

15. The device of claim 12, wherein the first connector is a plug and the second connector is a socket.

16. The device of claim 12, wherein a retention force is provided by the connection of the first connector and the second connector, wherein a spring force is provided in an opposite direction of the retention force by a deflection of the spring fingers between the first and second circuit boards when the first connector and the second connector are connected, and wherein the retention force is greater than the spring force.

17. The device of claim 12, wherein the plurality of spring fingers is connected to and extends from a first surface of the first circuit board or a base support adjacent to the first surface of the first circuit board.

18. The device of claim 17, further comprising:

at least one spring finger extending from a second surface of the first circuit board or a base support adjacent to the second surface of the first circuit board, the second surface being opposite from and parallel with the first surface.

19. The device of claim 18, wherein a retention force is provided by the connection of the first connector and the second connector, wherein a spring force is provided in an opposite direction of the retention force by a deflection of the spring fingers between the first and second circuit boards when the first connector and the second connector are connected, wherein an opposing spring force is provided by a deflection of the at least one spring finger extending from the second surface by a component adjacent to second surface of the first circuit board, and wherein a sum of the retention force and the opposing spring force is greater than the spring force.

20. The device of claim 12, wherein a fraction of the plurality of spring fingers is connected to and extends from a first surface of the first circuit board or a base support adjacent to the first surface of the first circuit board, and wherein a remaining fraction of the plurality of spring fingers is connected to and extends from a first surface of the second circuit board or a base support adjacent to the first surface of the second circuit board.

* * * * *